US007870828B2

(12) United States Patent
Mezger et al.

(10) Patent No.: US 7,870,828 B2
(45) Date of Patent: Jan. 18, 2011

(54) DEVICE FOR PRODUCING THREAD-STITCHED BOOK BLOCKS

(75) Inventors: Franz Mezger, Lauda Königshofen (DE); Holger Arendt, Grossrinderfeld-Gerchsheim (DE)

(73) Assignee: Muller Martini Holding AG, Hergiswil (CH)

( * ) Notice: Subject to any disclaimer, the term of this patent is extended or adjusted under 35 U.S.C. 154(b) by 816 days.

(21) Appl. No.: 11/787,190

(22) Filed: Apr. 13, 2007

(65) Prior Publication Data

US 2007/0251437 A1 Nov. 1, 2007

(30) Foreign Application Priority Data

Apr. 20, 2006 (EP) ..... 06405170

(51) Int. Cl.
*D05B 23/00* (2006.01)
*D05B 85/00* (2006.01)
*B42B 2/02* (2006.01)

(52) U.S. Cl. ..... 112/21; 112/222; 412/35

(58) Field of Classification Search ..... 112/21, 112/89, 222; 223/104; 281/27, 21.1; 412/7, 412/33, 35, 38

See application file for complete search history.

(56) References Cited

U.S. PATENT DOCUMENTS

| | | | | | |
|---|---|---|---|---|---|
| 414,090 | A * | 10/1889 | Taylor | 72/468 |
| 461,602 | A * | 10/1891 | Boult | 28/115 |
| 653,782 | A * | 7/1900 | Schoenfeld | 112/89 |
| 722,105 | A * | 3/1903 | Hervey | 223/104 |
| 881,894 | A * | 3/1908 | Braun | 112/89 |
| 3,521,583 | A * | 7/1970 | Pozzolo | 112/64 |
| 4,599,956 | A * | 7/1986 | Kobler et al. | 112/89 |
| 5,887,532 | A * | 3/1999 | Hollenstein et al. | 112/21 |
| 2005/0223956 | A1 * | 10/2005 | Fukuyama | 112/222 |
| 2007/0044696 | A1 * | 3/2007 | Yang | 112/222 |

FOREIGN PATENT DOCUMENTS

| | | |
|---|---|---|
| DE | 2 147 344 | 3/1972 |
| DE | 199 08 052 | 9/1999 |
| DE | 103 33 656 | 10/2004 |
| EP | 0 295 220 | 12/1988 |
| EP | 0 558 440 | 9/1993 |
| EP | 0 832 758 | 4/1998 |

OTHER PUBLICATIONS

"Polygraphische Technik", Veb Fachbuchverlag, Leipzig, Germany 1978, 1st Edition.

* cited by examiner

*Primary Examiner*—Ismael Izaguirre
(74) *Attorney, Agent, or Firm*—Lucas & Mercanti, LLP; Klaus P. Stoffel

(57) ABSTRACT

A device for producing thread-stitched book blocks from a stack of signatures are arranged flat one on top of the other and are stitched together by stitched seams formed at right angles to the folds by a binding thread passed repeatedly in double strands through the folds of the signatures. The device has a first stitching needle that inserts the binding thread and a second stitching needle that draws the binding thread through the fold from the inside. A punch needle, which passes through the fold from the inside edge to form a punched hole, is arranged opposite the first and second stitching needles, each of which forms a stitched seam. The section of the needle that is used to pierce a fold has a polygonal cross-sectional shape.

8 Claims, 3 Drawing Sheets

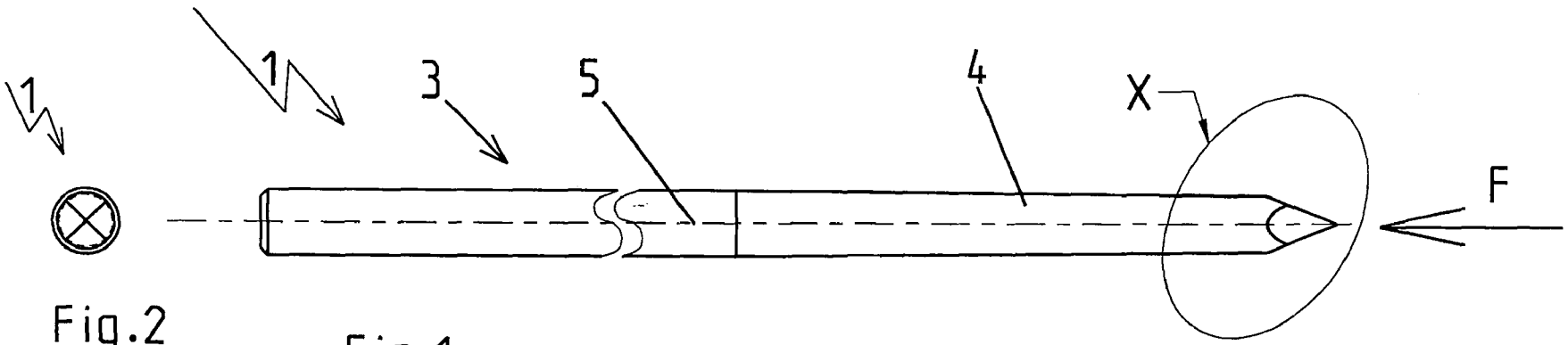
Fig.1
Fig.2
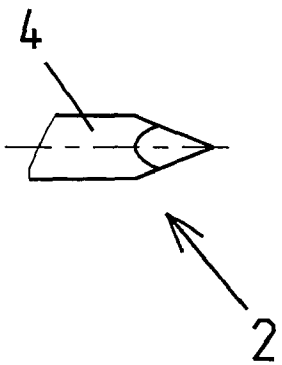
Fig.3

DEVICE FOR PRODUCING THREAD-STITCHED BOOK BLOCKS

BACKGROUND OF THE INVENTION

1. Field of the Invention

The present invention relates a device for producing thread-stitched book blocks from a stack of signatures, wherein the signatures are arranged flat one on top of the other and are stitched together by stitched seams formed at right angles to the folds by a double-stranded binding thread that passes through the folds of the signatures from the outside to the inside, runs along the inside edge of the folds, and passes through the folds from the inside to the outside. For each of the stitched seams is provided a first stitching needle that inserts the binding thread through a fold of a signature from the outside and a second stitching needle that draws the binding thread through the fold of this signature from the inside. Means are provided for carrying the binding thread along the inside edge of the fold from the first stitching needle to the second stitching needle, also referred to as a hooked needle. A punch needle, which passes through the fold from the inside edge to form a punched hole, is arranged opposite the first and second stitching needles, each of which forms a stitched seam.

2. Description of the Related Art

A device of the type described above is described in detail, e.g., in the book, "Polygraphische Technik" ("Polygraphic Technology"), VEB Fachbuchverlag, Leipzig, Germany 1978, 1st Edition, EP 0 295 220 A and EP 0 832 758 A2.

These thread-stitching devices use stitching needles and punch needles whose tip consists of a conical section attached to a cylindrical shaft. The conical tip of the needle and the shaft that follows it form circular holes when they pierce the fold. After the stitching operation, a binding thread runs through the holes and holds the signatures together in a book block. The spine of the bound book block is then glued to produce greater spine strength. The glue is applied with slight hang-out of the spine between pressing jaws, so that pressure is produced on the peripheries of the holes through which the binding thread passes. However, this pressure is not sufficient to close completely the holes that are present, so that the glue supplied to the spine of the book block can penetrate the holes and can emerge at the inside edge of a fold. The appearance of the glue at the inside edges of the fold detracts from the quality of the book block.

A wedge-shaped tip of a punch needle is also known and is used for the purpose of producing a squeezable hole. The use of this punch needle leads to the corners of the resulting rectangular holes being torn out.

SUMMARY OF THE INVENTION

The object of the present invention is to eliminate the disadvantages described above.

In accordance with the invention, this object is met by providing the section of the needle that is used to pierce a fold has a polygonal cross-sectional shape.

In the signatures, the structural feature according to the invention leads to deformation of the punched holes in the fold that is more effective with the available pressure on the face of the signatures, especially on the folds, since the polygonal shape can be compressed more easily and squeezed flat, so that a greater sealing effect can be obtained at the holes, which largely prevents the passage of glue through the folds. In this connection, it is important that the punch needles leave a hole with a polygonal shape after piercing the fold.

The device is found to be advantageous if a tip located at the front end of a needle has a polygonal cross-sectional shape at least at the rear end relative to the piercing direction.

Alternatively, the tip of a needle can have a polygonal cross-sectional shape, for example, with three or more angles.

Preferably, at least the punch needles have a polygonal cross-sectional shape.

It is advantageous for the cross-sectional shape to have at least three angles, so that the desired effect can be achieved.

The cross section can also be star-shaped.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 1 is an elevational view of a punch needle according to the invention for producing thread-stitched book blocks.

FIG. 2 is a side view of the punch needle shown in FIG. 1 in arrow direction F.

FIG. 3 is an enlarged view of detail X in FIG. 1.

DETAILED DESCRIPTION OF THE INVENTION

Figure 6:
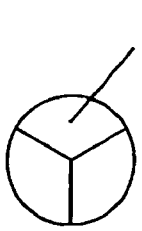
FIG. 6 is a side view of the needle shown in FIG. 4 as seen in the direction of arrow P.

FIGS. 1 to 3 illustrate a punch needle 1 of a device for producing thread-stitched book blocks, as described at the beginning. The stitching needles that guide the binding thread can also be included or constructed in accordance with the features proposed in accordance with the invention.

The punch needle 1 consists essentially of a needle tip 2 attached to a needle shaft 3. The needle shaft 3 serves the purpose of clamping the needle or punch needle 1 at one end, while the needle tip 2 at the other, front end of the punch needle 1 serves the purpose of punching holes through the inner edge of the fold of signatures. The cylindrically shaped needle shaft 3 runs conically with a slight taper towards the needle tip 2, at least to a length that corresponds to the movement of the needle during the piercing of the fold, so that the needle can be drawn back without getting stuck on the edges of the pierced holes or on the signatures. The conicity of the so-called punch shaft 4 starting from the needle shaft cross section or diameter can be the determining factor for the former. The punch needle 1 illustrated in FIGS. 1 to 3 has a pyramidal needle tip 2, whose free end is located on the longitudinal center axis 5 of the needle. This alignment between the needle tip 2 and the longitudinal center axis 5 of the needle is not absolutely necessary for success.

The other FIGS. 4 to 10 show alternative embodiments of a needle tip 2 for stitching needles and punch needles.

Figure 4:
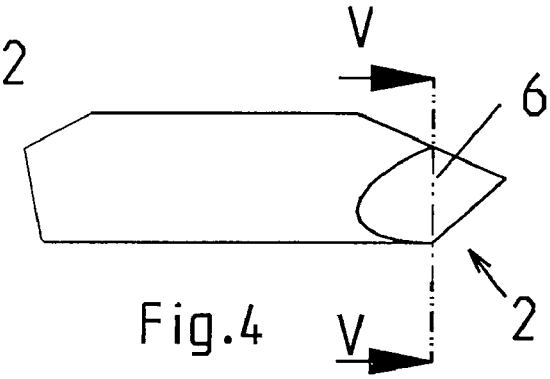
FIG. 4 is an alternative needle in accordance with the invention.
Figure 5:
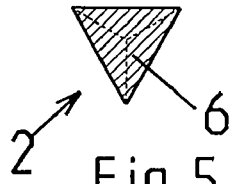
FIG. 5 is a sectional view along line V-V through the tip of the needle shown in FIG. 4.

The needle tip 2 of the punch needle 1 according to FIGS. 4 to 6 has a pyramidal shape with three lateral surfaces 6 arranged with a regular distribution. In the transition zone to the needle shaft 4, these lateral surfaces 6 form a curved line of penetration with the needle shaft 4.

Figure 7:
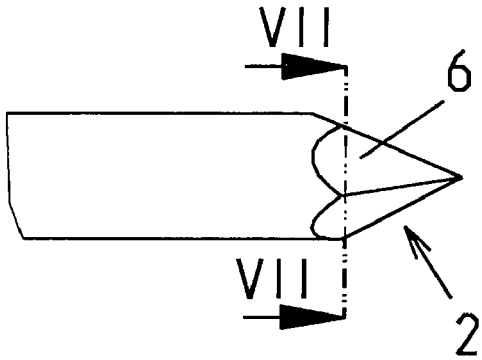
FIG. 7 shows another alternative needle in accordance with the invention.
Figure 8:
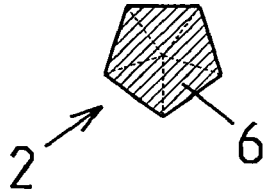
FIG. 8 is a sectional view taken along line VIII-VIII through the tip of the needle shown in FIG. 7.

Similar geometric conditions are found in a pyramidal needle tip 2 with five lateral surfaces 6, as shown in FIGS. 7 and 8.

Figure 9:
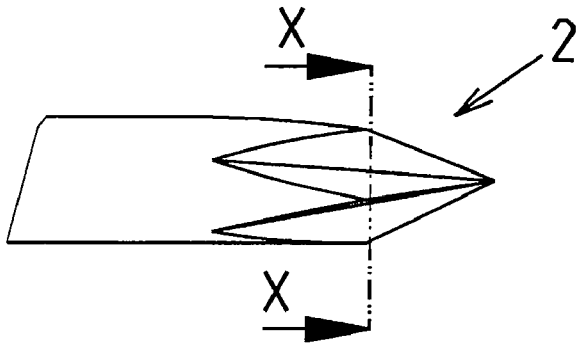
FIG. 9 shows another embodiment of the needle in accordance with the invention.
Figure 10:
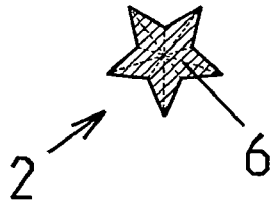
FIG. 10 is a sectional view taken along line X-X through the tip of the needle shown in FIG. 9.

The needle tip 2 of a punch needle 1 according to FIGS. 9 and 10 has a star-shaped cross section, in which the wedge-shaped lateral surfaces 6 are arranged in the form of a star.

Figure 11:
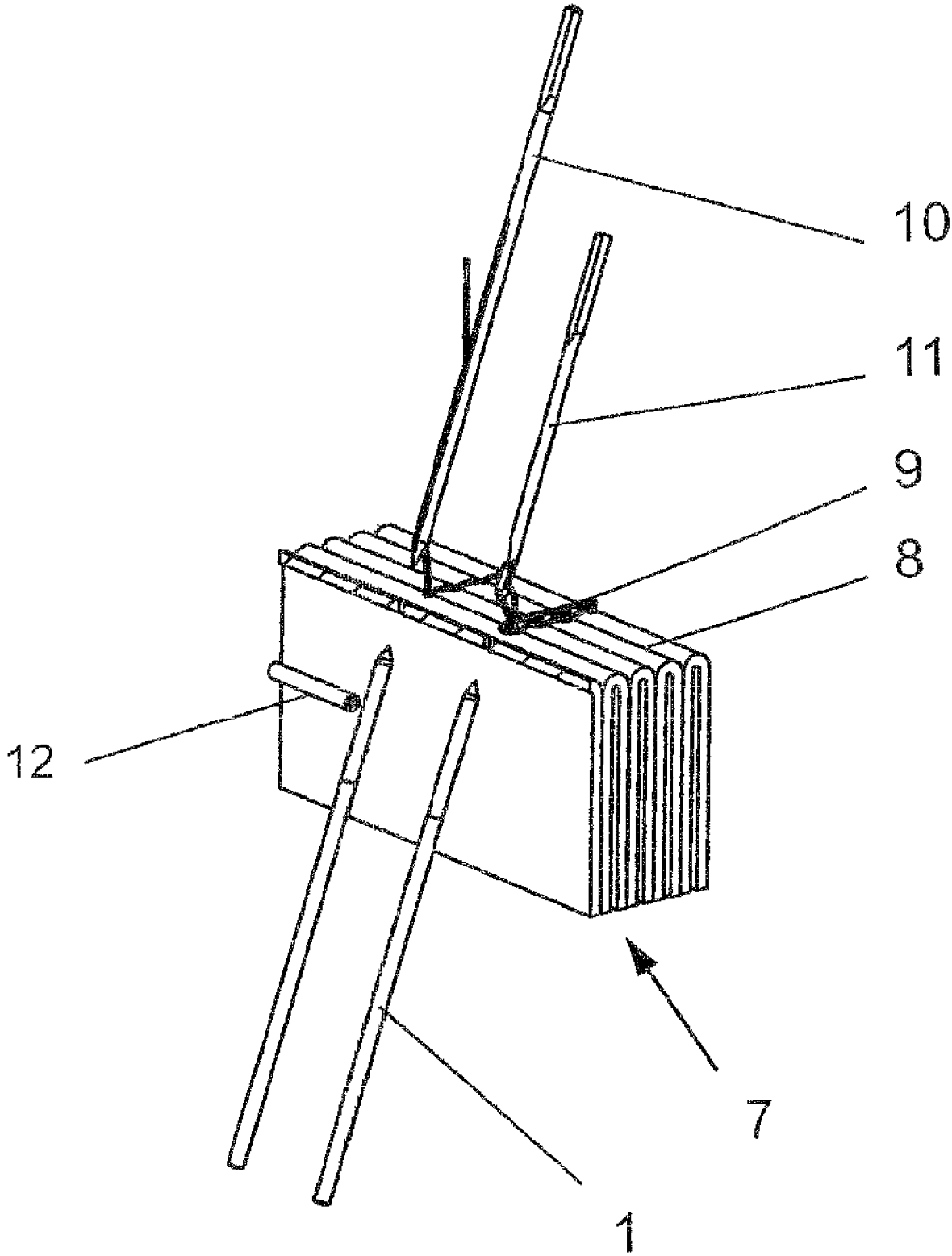
Fig. 11 (Prior Art)
FIG. 11 is a schematic illustration of a prior art needle.

A prior art apparatus is shown in FIG. 11. This apparatus is used for producing thread-sewn book blocks from a stack of flat sheets 7 arranged next to one another. The sheets are bound together by double-strand binding threads that pass through a fold 8 of the sheets from outside to inside, that run along an inner edge of the fold 8 and are pulled out of the folds 8 at a respective exit position. The threads form stitches 9 that run perpendicular to the folds 8 and parallel to each other, wherein the stitches 9 each have one of the binding threads provided from outside a fold 8 by a first penetrating, sewing needle 10, which thread is pulled out of the fold 8 at the exit position by a second sewing needle 11. Means 12 are provided for connecting the continuously-guided thread on the first sewing needle 10 with the second sewing needle 11, within a spread apart printed sheet.

While specific embodiments of the invention have been shown and described in detail to illustrate the inventive principles, it will be understood that the invention may be embodied otherwise without departing from such principles.

We claim:

1. A device for producing thread-stitched book blocks from a stack of signatures, wherein the signatures are arranged flat one on top of the other and are stitched together by stitched seams formed at right angles to the folds by a double-stranded binding thread that passes through folds of the signatures from an outside to an inside thereof, runs along the inside edge of the folds, and passes through the folds from the inside to the outside, the device comprising for each of the stitched seams a first stitching needle for inserting the binding thread through a fold of a signature from the outside and a second stitching needle for drawing the binding thread through the fold of this signature from the inside, further comprising means for carrying the binding thread along an inside edge of the fold from the first stitching needle to the second stitching needle, and a punch needle, which passes through the fold from the inside edge to form a punched hole, is arranged opposite the first and second stitching needles, wherein a section of a needle used for piercing a fold has a polygonal cross-sectional shape.

2. A device in accordance with claim 1, wherein a tip located at a front end of the needle has a polygonal cross-sectional shape.

3. A device in accordance to claim 1, wherein the section of the needle is a rear end relative to the piercing direction.

4. A device in accordance with claim 1, wherein the tip of the needle has a polygonal cross-sectional shape.

5. A device in accordance with claim 1, wherein at least the punch needles have a polygonal cross-sectional shape.

6. A device in accordance with claim 1, wherein the cross-sectional shape has at least three angles.

7. A device in accordance with claim 1, wherein the cross section is more or less star-shaped.

8. A device in accordance with claim 1, wherein the free end of the needle is located on the longitudinal center axis of the needle.

* * * * *